United States Patent [19]

Lamirand et al.

[11] Patent Number: 5,032,422

[45] Date of Patent: Jul. 16, 1991

[54] ELECTROSTATICALLY DEPOSITING AND ELECTROSTATICALLY NEUTRALIZING

[75] Inventors: Joseph B. Lamirand, Muncie, Ind.; Dwight B. Raddatz, Woodridge, Ill.

[73] Assignee: Ball Corporation, Muncie, Ind.

[21] Appl. No.: 457,001

[22] Filed: Dec. 26, 1989

[51] Int. Cl.[5] ..... B05D 1/04; B05B 5/03

[52] U.S. Cl. ..... 427/33; 118/627; 118/634

[58] Field of Search ..... 427/25, 27, 32, 33; 118/627, 630, 634

[56] References Cited

U.S. PATENT DOCUMENTS 3,323,934 6/1967 Point ..... 118/630 X 3,991,710 11/1976 Gourdine et al. ..... 118/630 X 4,073,966 2/1978 Scholes et al. ..... 427/33 X 4,170,193 10/1979 Scholes et al. ..... 118/627

*Primary Examiner*—Evan Lawrence

*Attorney, Agent, or Firm*—Gilbert E. Alberding

[57] ABSTRACT

Apparatus (74) and method are provided for electrostatically depositing particles (64) of a first material onto a sheet (18) of a second material, and for electrostatically neutralizing the residual charge. The apparatus (74) includes a particle generator (20) for aspirating particles (64) of the first material, electrodes (60*a* and 60*b*) for electrostatically charging the particles (64) to a first polarity, an electrode (75) for electrostatically recharging a portion of the particles (64) to the opposite polarity, and a depositing chamber (22) for electrostatically depositing the particles of the opposite polarity subsequent to depositing the particles of the first polarity.

22 Claims, 4 Drawing Sheets

ELECTROSTATICALLY DEPOSITING AND ELECTROSTATICALLY NEUTRALIZING

BACKGROUND OF THE INVENTION

1. Field of the Invention

The present invention relates to electrostatically depositing coatings. More particularly, the present invention relates to apparatus and method for electrostatically coating substrates with particulate materials, and for electrostatically neutralizing the residual electrostatic charge.

2. Description of the Related Art

The process of electrostatic depositing is used for depositing various kinds of materials onto metal objects or sheets. Uses for electrostatic depositing include depositing of: paint, dry powder coatings, abrasives, flocking materials, and lubricants. In addition, electrostatic depositing is used to reproduce printed material and pictures by the process that is known as xerography.

Examples of the related art in depositing of lubricants are: Scholes et al., U.S. Pat. No. 4,066,803, issued 3 Jan. 1978; and Jenkins et al., U.S. Pat. No. 2,608,176, issued 16 Mar. 1948. In like manner, Escallon, U.S. Pat. No. 4,526,804, issued 2 July 1985, and Rocks et al., U.S. Pat. No. 3,155,545, issued 27 Feb. 1961, are examples of the related art in depositing granular materials; whereas Wiggins, U.S. Pat. No. 3,937,180, issued 10 Feb. 1976, and Cosentino et al., U.S. Pat. No. 4,724,154, issued 9 Feb. 1988, are examples of patents which teach electrostatic depositing of paint.

Two problems have attended electrostatic depositing. One is that the process of electrostatic depositing can develop a residual electrostatic potential on the coated material. Where materials with dielectric properties, such as lubricants, are deposited, the deposited material can retain a residual electrostatic charge. In the case of electrostatically lubricated metallic sheets, the residual electrostatic charge has caused sheets in a stack to stick together, and has electrostatically attracted contaminants from the air to lodge on the coated material.

The second problem is that of meeting increasingly strict ecological standards in that some of the coating material drifts out, or is blown out, of the depositing chamber.

A primary cause of the coating material drifting out of the depositing chamber is that, as the substrate becomes electrostatically coated, it can acquire the charge of the deposited material, reducing the electrical potential between the charged particles which are to be deposited and the substrate, and thereby allowing charged particles to drift out of the depositing chamber rather than being attracted to the depositing surface.

It has been found that, even though a metallic sheet or coil of metallic material is exposed to contact with the transporting apparatus, the surface of the sheet or coil can retain an electrical potential sufficient to spark to a metallic object that is spaced from the coated sheet or coil. This is particularly true of sheets.

The related art includes some attempts to correct the problem of a residual electrostatic charge. For instance, Gibbons et al., U.S. Pat. No. 3,702,258, issued 7 Nov. 1972, teach a method for neutralizing the residual electrostatic charge that remains after treating a web with an alternating current corona field to increase its printability. The apparatus of Gibbons et al., includes a positively energized roller and a negatively energized roller which contact the web, and a pair of electrodes that are spaced apart from respective ones of the rollers on opposite sides of the web from that of the rollers, and that are connected to a potential that is intermediate of the potentials of the two rollers.

Also, in U.S. Pat. No. 4,517,143, issued 14 May 1985, Kisler teaches passing a randomly charged web through two oppositely-charged electrostatic fields to adjust the electrostatic field charge level to a desired and uniform level.

With regard to the ecological problem, the usual attempts have involved pulling excess coating material through the depositing chamber with an air evacuating system. Typical of these systems is Rocks et al., U.S. Pat. No. 3,155,545.

While the related art attacks these two problems separately, and more or less successfully, all of the prior art fails to provide apparatus and/or method which attacks both of these problems with a unified approach.

SUMMARY OF THE INVENTION

In the present invention, first particles of a lubricant are aspirated by a particle generator, the aspirated particles of lubricant are drawn into a depositing chamber by a plurality of first electrodes whose corona discharge ionizes the air within the chamber to a first polarity, the particles of lubricant are charged to the first polarity by the first electrodes, and the charged particles are deposited onto a substrate that is transported through the depositing chamber. If the substrate is not completely grounded, the deposited charged particles can cause a residual electrostatic charge on the coated substrate.

In a first aspect of the invention, a neutralizing electrode is placed in the depositing chamber, is effectively separated from first electrodes, and is energized to the opposite polarity from that of the first electrodes, thereby recharging some of the aspirated particles to the opposite polarity and neutralizing other particles. The oppositely-charged particles, and to some extent the neutralized particles, are then deposited onto the previously coated substrate, being attracted to the substrate by the residual charge on the coated substrate, and thereby neutralizing the residual electrostatic charge on the coated substrate.

The neutralizing electrode and the particles that are charged to the opposite polarity are effectively separated from the depositing electrodes by an increase in the distance between the neutralizing electrode and the closest depositing electrode by a distance that is greater than the distance between adjacent ones of the depositing electrodes.

In a second aspect of the invention, the neutralizing electrode and the particles that are charged to the opposite polarity are effectively separated from the depositing electrodes by a baffle that is placed between the neutralizing electrode and the depositing electrodes.

In a third aspect of the invention, separate depositing and neutralizing chambers are provided, and particles of coating material that ordinarily would be lost into the atmosphere are directed into the neutralizing chamber, recharged, and deposited onto the substrate.

In a fourth aspect of the invention, separate particle generators are provided for a depositing chamber and a neutralizing chamber.

In a fifth aspect of the invention, separate particle generators are provided for a depositing chamber and a neutralizing chamber, and the direction of transport of the substrate is reversed, so that the work piece enters the depositing chamber remote from the particle generator.

In a sixth aspect of the invention, a deflector and an electrode cooperate to direct particles toward the work piece, and a baffle separates depositing electrodes and positively-charged particles from a neutralizing electrode and negatively-charged particles.

DESCRIPTION OF THE PREFERRED EMBODIMENTS

Figure 1:
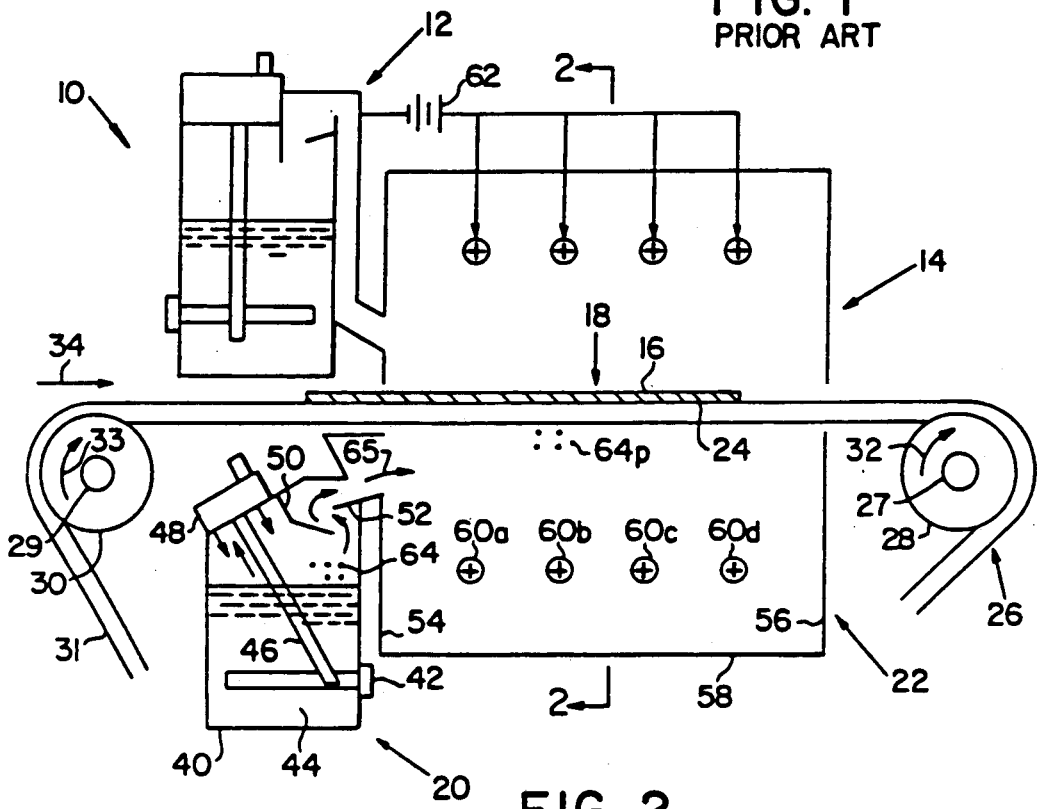
FIG. 1 PRIOR ART
FIG. 1 is a longitudinal cross-sectional elevation of a prior art apparatus for electrostatically depositing lubricant onto sheets of metallic material, and includes one depositing chamber for electrostatically coating the top surface of a metallic sheet and another depositing chamber for electrostatically coating the bottom surface of the metallic sheet.
Figure 2:
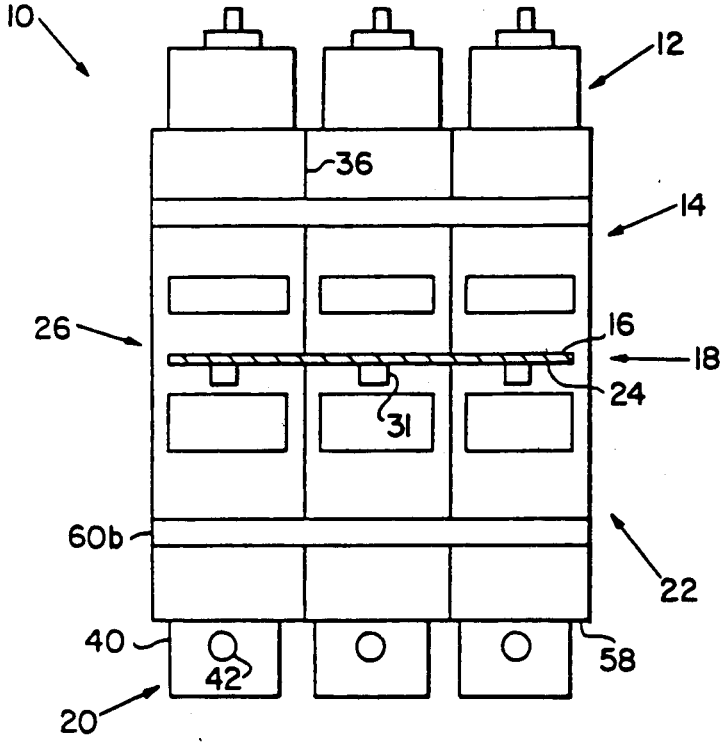
FIG. 2 PRIOR ART
FIG. 2 is a transverse cross-sectional elevation of the prior art apparatus of FIG. 1, taken substantially as shown by section line 2—2 of FIG. 1.

Referring now to the drawings, and more particularly to FIGS. 1 and 2, the prior art device shown in FIGS. 1 and 2 corresponds generally to the apparatus of Scholes et al., U.S. Pat. No. 4,066,803, and FIG. 1 corresponds more particularly to FIG. 9 of the aforesaid patent.

Continuing to refer to the prior art apparatus as shown in FIGS. 1 and 2, an electrostatic depositing apparatus 10 includes a first particle generator 12 and a first depositing chamber 14 for depositing lubricant onto a top surface 16 of work piece, or sheet, 18 of metallic material. In like manner, the electrostatic depositing apparatus 10 includes a second particle generator 20 and a second depositing chamber 22 for depositing lubricant onto a bottom surface 24 of the sheet 18 of material.

The electrostatic depositing apparatus 10 also includes a transporting mechanism 26 which transports the sheets 18 through, or between, the depositing chambers, 14 and 22. The transporting mechanism 26 includes a drive shaft 27 onto which are mounted drive pulleys 28, a driven shaft 29 upon which are mounted driven pulleys 30, and conveyor belts 31 which interconnect the drive pulleys 28 and the driven pulleys 30. The direction of rotation of the pulleys 28 and 30 are indicated by arrows 32 and 33; and the direction of transport of the sheet 18 is indicated by an arrow 34.

The aforesaid patent of Scholes et al. shows and describes the mechanism, and the mechanical details, for transporting the sheets 18, whereas the present invention does not involve these mechanical details. Therefore, it is unnecessary to describe these mechanical details herein. For instance, Scholes et al. show and describe the use of a plurality of drive pulleys, a plurality of driven pulleys, and a plurality of belts to transport a sheet 18 through their depositing chambers.

Further, Scholes et al. show and describe the use of a plurality of particle generators, 12 and 20, each providing a mist of lubricant for a portion of the width of the sheet 18, and they show and describe the use of longitudinally-disposed partitions 36 for dividing the depositing chamber into a plurality of depositing chambers 14 and 22. Each of the particle generators, 12 and 20, provide aspirated lubricant for one of the depositing chambers 14 and 22.

Further, even though the particle generators, 12 and 20, are somewhat different in appearance, their function is the same. Therefore, Applicant will describe only the portion of the depositing apparatus 10 which deposits lubricant onto the bottom surface 24 of the sheets 18.

The particle generator 20 includes a reservoir 40, an electric heater 42 that is disposed in a pool 44 of lubricant, a suction tube 46 which is disposed in the pool 44 of lubricant, an aspirator 48, and particle-separation baffles, 50 and 52.

The depositing chamber 22 includes a first end 54, a second end 56, and a bottom cover 58. Depositing electrodes **60*a*, 60*b*, 60*c*, and 60*d* are transversely disposed in the depositing chamber 22, are equidistantly spaced from each other, and are energized to a positive polarity by a source of high voltage, symbolized as a battery 62. The positive polarity of the electrodes 60*a*–60*d* is indicated by the "+" signs in FIG. 1**.

In operation, the pool 44 of lubricant in the reservoir 40 is kept in a liquid state by the heater 42; and lubricant is drawn up into the suction tube 46 by air being blown through a venturi, not shown, in the aspirator 48. The lubricant is then aspirated out of the aspirator 48 in droplets, or particles of lubricant 64, of various sizes. The largest ones of the particles 64, which comprise ninety percent of the total number of particles 64, drop back into the pool 44 of lubricant because they are unable to navigate a tortuous path, which is generally designated by arrows 65, and which is provided by the particle-separation baffles, 50 and 52.

In contrast to the largest of the particles 64, the remainder of the particles 64, which have diameters between one and ten microns, form a cloud of particles 64 which drifts through the particle-separation baffles, 50 and 52.

It is accurate to speak of the remainder of the particles 64 drifting through the particle-separation baffles, 50 and 52, because typically an air pressure of 10–30 pounds per square inch and an orifice diameter of 0.05 inches is used to aspirate the lubricant, producing an air flow in the neighborhood of merely 0.8 to 1.4 cubic feet per minute.

The air that is used by the particle generator 20 is sufficient to transport the smaller of the particles 64 toward the second end 56 of the depositing chamber 22. Therefore, it is also accurate to speak of the smaller of the particles 64 being transported from the first end 54 to the second end 56 of the depositing chamber 22. In like manner, since the supply of air to the particle generator 20 is so small, the air is unable to transport the larger of the particles toward the second end 56 of the chamber 22 before they are deposited; thus, it is accurate to speak of the smaller of the particles 64 being separated from the larger of the particles 64.

As the remainder of the particles 64 drift toward the depositing chamber 22, the electrodes, **60*a*–60*d*, which are energized by a voltage potential that is sufficient to produce a corona discharge, ionize the surrounding atmosphere, charging the atmosphere, and resulting in the formation of charged particles which collide with the particles 64 of lubricant, and charge the particles 64 within the depositing chamber 22** to the positive polarity.

The positively-charged particles are referred to hereafter as particles **64*p***.

The positively-charged particles **64*p* are attracted to the sheet 18 of metallic material which initially is at, or near, ground potential, as shown by the electrical schematic of FIG. 1**.

Figure 3:
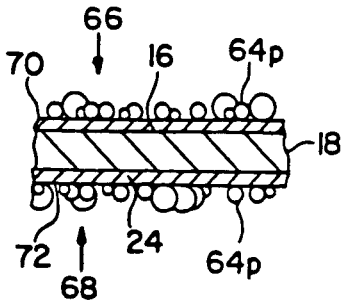
FIG. 3 PRIOR ART
FIG. 3 is an enlarged cross section of a portion of a sheet of material which has been coated on both sides with a coating such as a paint, and which has been electrostatically coated subsequently with spheres of a lubricant.

Referring now to FIGS. 1 and 3, as the sheet 18 is transported through the depositing chamber 22 at a velocity upwardly of 300 feet per minute, and as particles **64*p* of lubricant are electrostatically deposited, the top and bottom surfaces, 16 and 24, of the sheet 18** start to build up a positive electrostatic charge.

Referring now to FIGS. 1–3, as the sheet 18 proceeds from the first end 54 to the second end 56 of the depositing chamber 22, and as the electrostatic depositing of the particles **64*p* continues progressively, a positive charge may build up to a potential which results in sparking from the metallic sheet 18 to a part of the apparatus, not shown, that is as much as twelve centimeters away from the sheet 18**.

Referring now to FIG. 3, the sheet 18 has been coated previously with layers of paint, 70 and 72. The layers of paint may form an insulating coating that prevents grounding of the metal sheet and discharge of the charged lubricant particles. On top of these layers of paint, 70 and 72, are the coatings, 66 and 68, of lubricant. Since the layers of paint, 70 and 72, can isolate the charged lubricant particles from the metal sheet and from "ground", and since the areas of the surfaces, 16 and 24, of the sheet 18 are quite large, it is apparent that the painted and lubricated sheet 18 can develop a tremendously large electrical charge. Thus, with some sheets, a very large electrostatic charge can remain on the sheet 18, even though the sheet 18 is contacted by the apparatus, and it is likewise understandable that this large charge can cause problems.

As noted previously, problems which attend this electrostatic charging of the sheet 18 include: 1) lubricated sheets that tend to stick together; and 2) a build-up of electrostatic charge that decreases the attraction of positively-charged particles, so that an excessively large percentage of the particles **64*p* drift out of the depositing chamber 22**.

Figure 4:
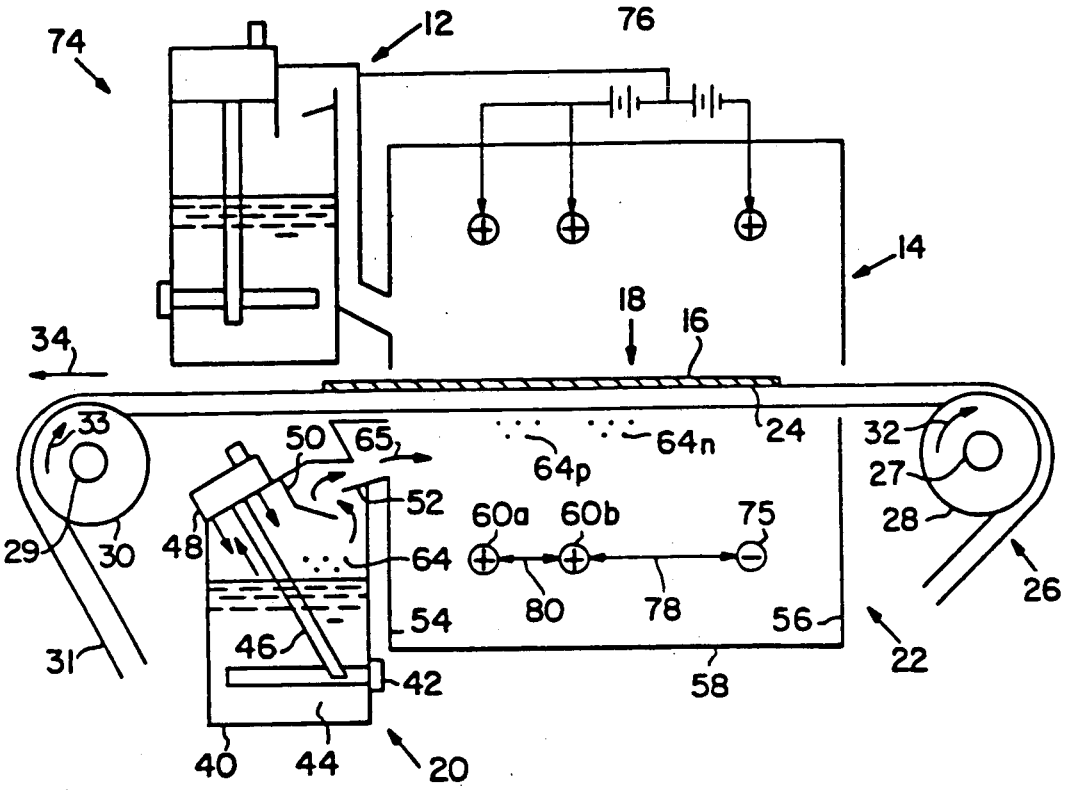
FIG. 4 is a cross-sectional elevation of a first embodiment of the present invention wherein neutralizing electrodes, one for the top surface of the substrate and one for the bottom surface of the substrate, are included in the respective depositing chambers, are energized at the polarity that is opposite to that of the depositing electrodes, and are effectively separated from adjacent ones of the depositing electrodes by a space that is larger than the space between adjacent ones of the depositing electrodes.

Referring now to FIG. 4, a depositing apparatus 74 illustrates a first preferred embodiment of the present invention. Since the prior art embodiment of FIG. 1 and the first preferred embodiment of FIG. 4 include like-numbered and like-named parts, they will not be recited except as necessary to describe the operation and advantages of the depositing apparatus 74 of FIG. 4.

The embodiments of FIGS. 1 and 4 are identical except that, in the depositing apparatus 74 of FIG. 4, two of the depositing electrodes, **60*c* and 60*d*, have been removed, a neutralizing electrode 75 has replaced the depositing electrode 60*d*, and a source of high electrical voltage 76 which is symbolized by two batteries, 76*a* and 76*b*,provides a positive polarity to the depositing electrodes, 60*a* and 60*b*, a grounded reference voltage to the apparatus 74, and a negative polarity to the neutralizing electrode 75**.

Since the place of the electrode **60*c* of FIG. 1 has been left vacant in FIG. 4, a distance 78 between the depositing electrode 60*b* and the neutralizing electrode 75 is twice as great as a distance 80 between the depositing electrodes, 60*a* and 60*b*. Therefore, the distance 78 serves as a means for effectively separating the depositing electrodes, 60*a* and 60*b*, from the neutralizing electrode 75**.

As a positive electrostatic potential builds up on the bottom surface 24 of the sheet 18, as described in conjunction with FIG. 1, some of the positively-charged particles **64*p* drift toward the neutralizing electrode 75 and are recharged to negatively-charged particles 64*n***.

Therefore, the distance 78 serves also as a means for separating the positively-charged particles **64*p* from particles that have been recharged from positively-charged particles 64*p* to negatively-charged particles 64*n***. Such separation discourages recombination of the oppositely-charged particles and neutralization of their depositing charges and agglomerations, although agglomeration of the small lubricant particles is unlikely.

Then the negatively-charged particles **64*n* are attracted to the positive charge on the bottom surface 24 of the sheet 18, and are deposited as a part of the coating 68. The resultant advantages are: 1) the residual electrostatic charge of the sheet 18 is reduced greatly; and 2) the recharged particles 64*n* are deposited onto the sheet 18, rather than being urged to drift out of the depositing chamber 22** by the repelling force of like-charged particles.

Figure 5:
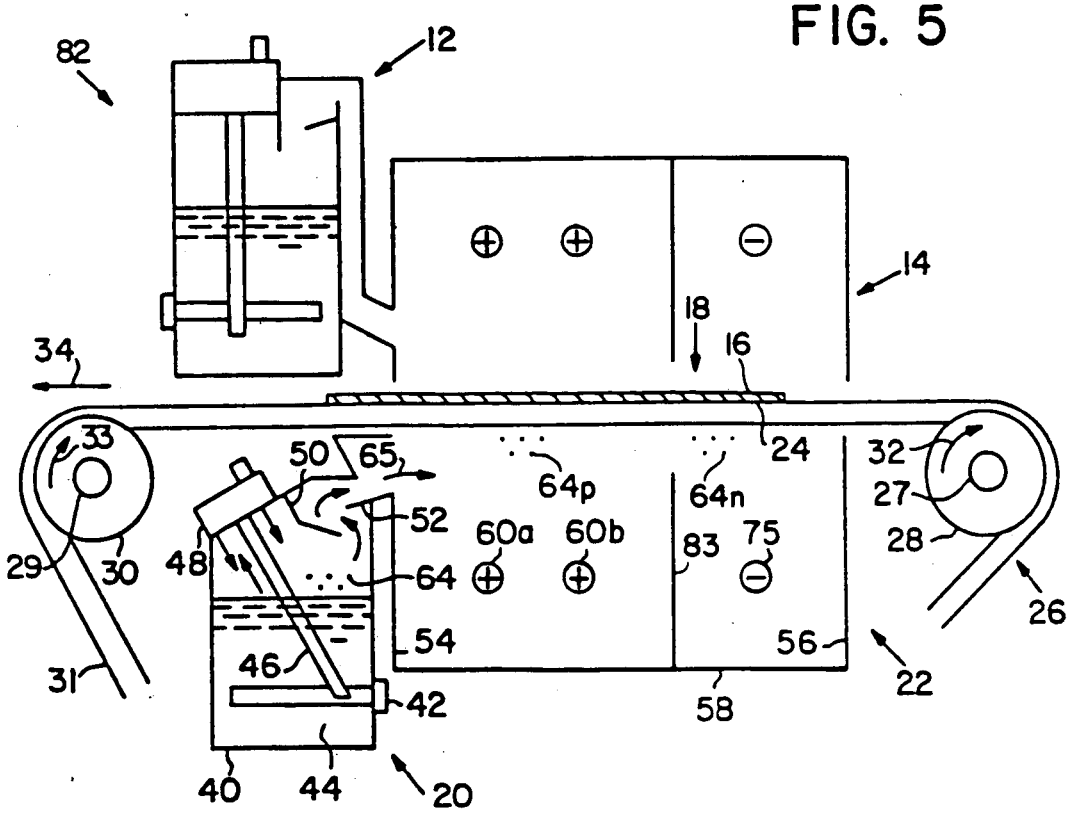
FIG. 5 is a cross-sectional elevation of a second embodiment of the present invention, and differs from the embodiment of FIG. 4 in that a baffle in each of the depositing chambers effectively separates the neutralizing electrode from the depositing electrodes, and effectively separates positively-charged particles from negatively-charged particles.

Referring now to FIG. 5, a depositing apparatus 82 illustrates a second preferred embodiment of the present invention and is identical with the first preferred embodiment of FIG. 4, except that a baffle, or barrier, 83 has been inserted between the depositing electrode 60*b* and the neutralizing electrode 75. The operation is the same, that is, some of the positively-charged particles 64*p* are recharged to be negatively-charged particles 64*n*. The baffle 83 serves as means for effectively separating the depositing electrodes, 60*a* and 60*b*, from the neutralizing electrode 75, and also serves as means for effectively separating the positively-charged particles 64*p* from the negatively-charged particles 64*n*.

Figure 6:
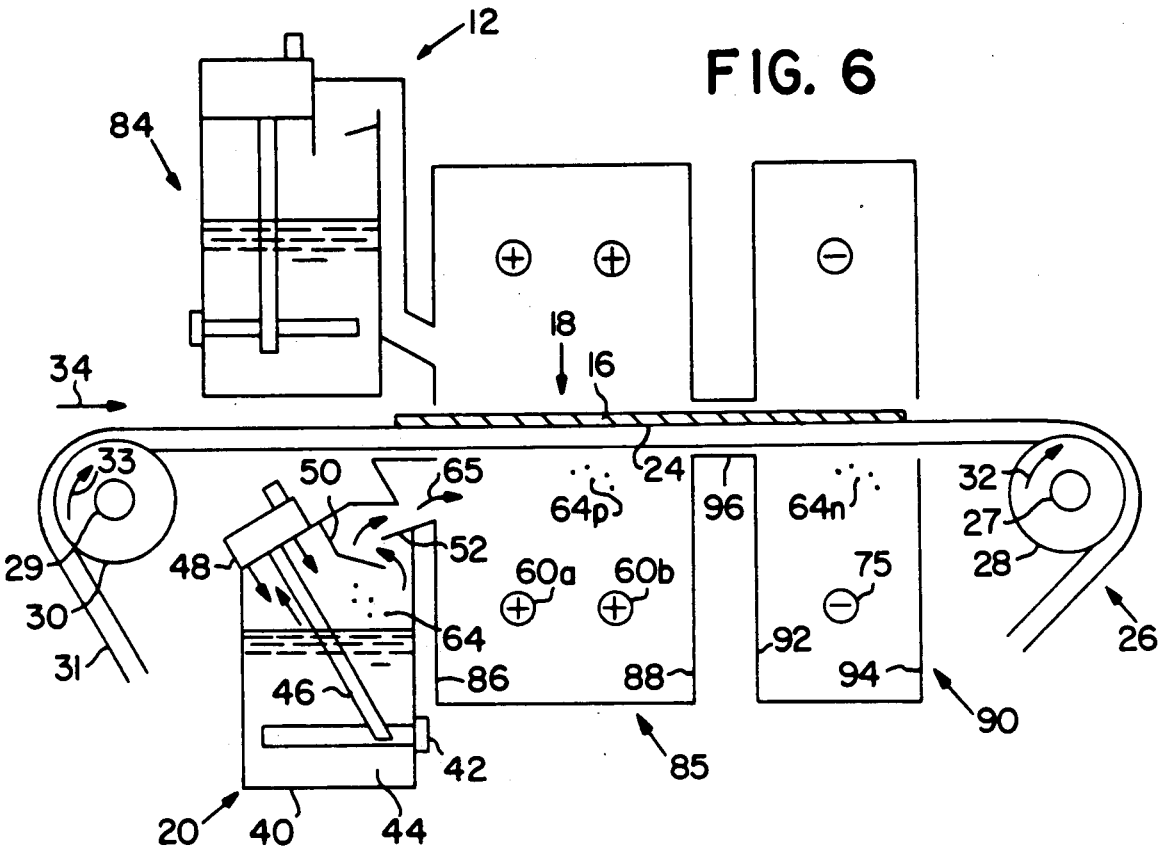
FIG. 6 is a cross-sectional elevation of a third embodiment of the present invention, and differs from the embodiments of FIGS. 4 and 5 in that separate neutralizing chambers effectively separate the neutralizing electrodes from the depositing electrodes, and effectively separate positively-charged particles from negatively-charged particles.

Referring now to FIG. 6, a depositing apparatus 84 illustrates a third embodiment of the present invention. In the apparatus 84, the depositing electrodes, 60*a* and 60*b*, are enclosed in a depositing chamber 85 that includes a first end 86 and a second end 88; and the neutralizing electrode 75 is enclosed in a neutralizing chamber 90 that includes both a first end 92 and a second end 94. The depositing chamber 85 and the neutralizing chamber 90 are interconnected by means of a passageway, or rectangular conduit 96. The passageway 96 allows positively-charged particles 64*p* to drift, or to be transported, from the depositing chamber 85 to the neutralizing chamber 90 without escaping into the atmosphere.

Generally, the advantages of the depositing apparatus 84 of FIG. 6 are the same as the embodiments of FIGS. 4 and 5. The primary advantage of the FIG. 6 embodiment over that of the embodiments of FIGS. 4 and 5, is that better separation is provided between the positively-charged particles 64*p* and the negatively-charged particles 64*n*.

Figure 7:
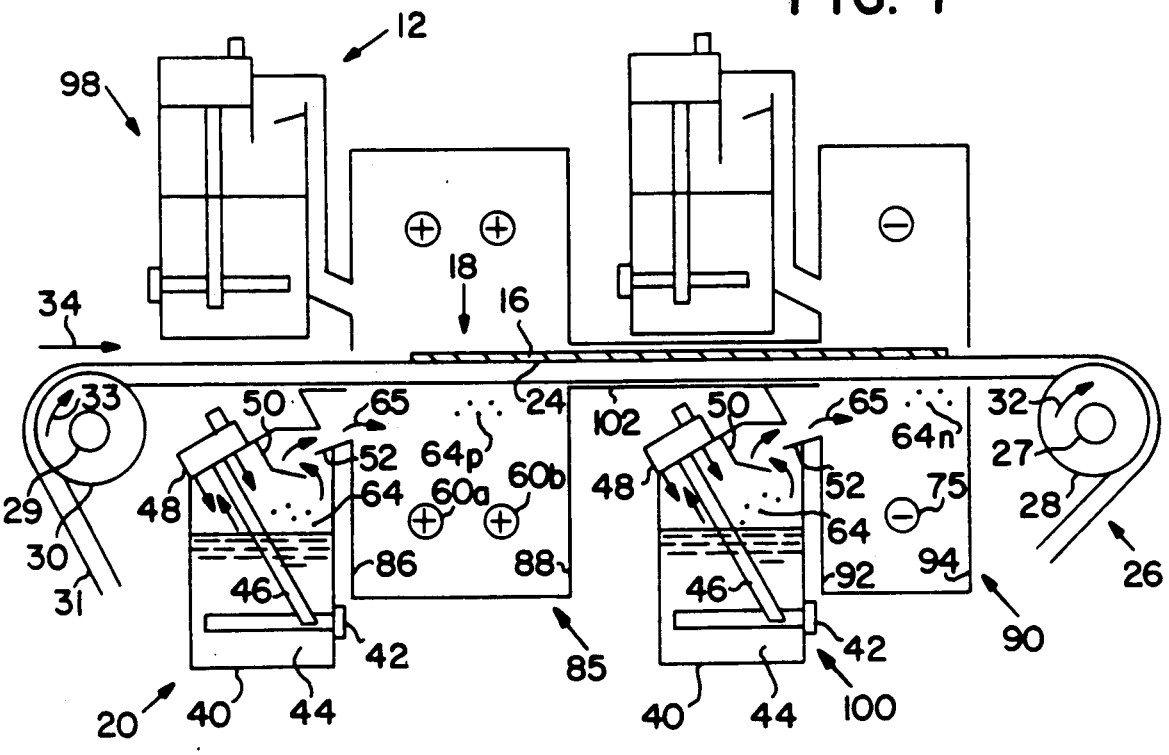
FIG. 7 is a cross-sectional elevation of a fourth embodiment of the present invention, and differs from the embodiment of FIGS. 4 and 5 in that separate neutralizing chambers separate the neutralizing electrodes from the depositing electrodes, and in that separate particle generators supply particles of lubricant to the depositing and neutralizing chambers.

Referring now to FIG. 7, a depositing apparatus 98 illustrates a fourth embodiment of the present invention. The neutralizing chamber 90 is spaced farther from the depositing chamber 85 than shown for FIG. 6, so that a third particle generator 100 can be interposed between the two chambers, 85 and 90 above and below sheet 18. As clearly shown, the particle generator 100 furnishes particles 64 of lubricant to the neutralizing chamber 90; so the neutralizing chamber 90 is not dependent upon positively-charged particles 64*p* drifting out of the depositing chamber 85 and into the neutralizing chamber 90. A passageway, or rectangular conduit, 102 connects the depositing chamber 85 to the neutralizing chamber 90; so that positively-charged particles 64*p* can drift, or be transported by aspirating air, out of the depositing chamber 85, and into the neutralizing chamber 90 without contaminating the atmosphere.

Figure 8:
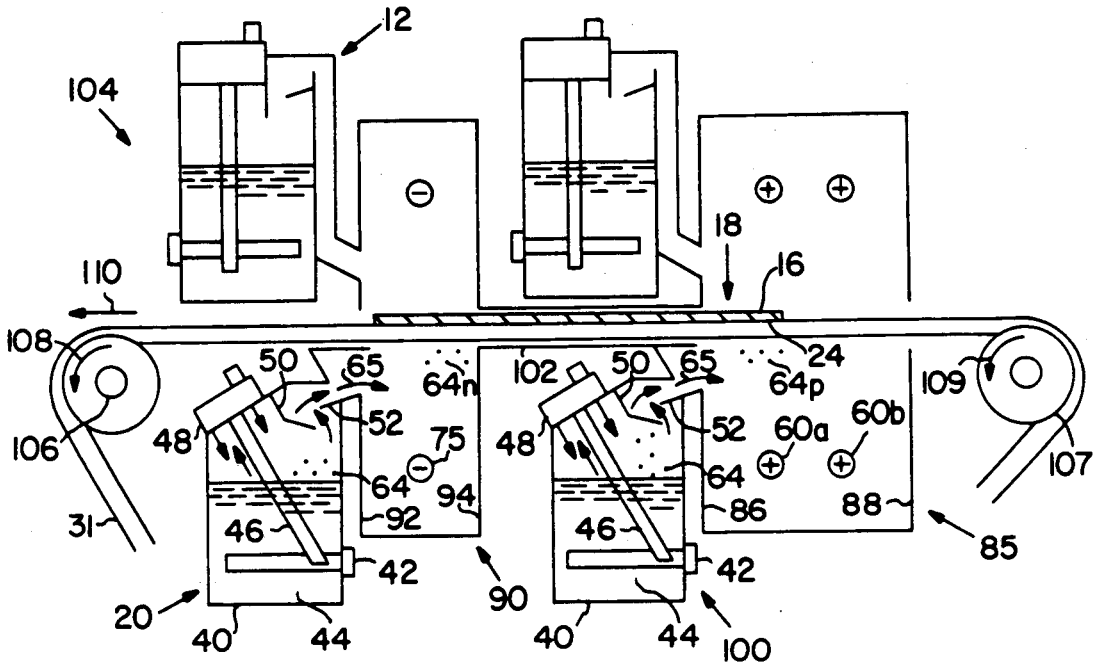
FIG. 8 is a cross-sectional elevation of a fifth embodiment of the present invention, and differs from the embodiment of FIG. 7 in that the substrate being electrostatically coated is transported in the opposite direction.

Referring now to FIG. 8, a depositing apparatus 104 illustrates a fifth embodiment of the present invention. In the depositing apparatus 104, the direction of transport of the sheet 18 has been reversed from that of FIGS. 1, 4–7, and 9. In the depositing apparatus 104, a drive pulley 106 replaces the driven pulley 30 of FIG. 1, a driven pulley 107 replaces the drive pulley 28 of FIG. 1, the direction of rotation of the pulleys 106 and 107 are shown by arrows 108 and 109, and the direction of transport of the belts 31 and the sheet 18 is shown by an arrow 110.

Referring now to FIG. 1, the largest particles 64 of lubricant drop back into the pool 44 of lubricant, the remainder of the particles 64 proceed into the chamber 22 and are electrostatically charged to a positive polarity, the largest of the positively-charged particles 64*p* are electrostatically deposited onto the sheet 18, and the smaller of the positively-charged particles 64*p*, are allowed to migrate toward the second end 56 of the depositing chamber 22.

As the sheet 18 proceeds through the depositing chamber 22, the larger of the particles 64*p* being more amenable to electrostatic depositing, are deposited first, and the smaller of the particles 64*p* tend to migrate away from the end 54 that is proximal to the particle generator 20, and toward the end 56 that is distal from the particle generator 20.

As the larger of the particles 64*p* are deposited onto the sheet 18, the sheet 18 starts to build up a positive electrostatic charge; and this positive electrostatic charge on the sheet 18 reduces the attraction between the positively-charged particles 64*p* and the sheet 18.

This reduction in attraction between the positively-charged particles 64*p* and the sheet 18, is not sufficient to significantly interfere with the depositing of the larger of the positively-charged particles 64*p*, but is sufficient to significantly interfere with the depositing of the smaller of the particles 64*p*, so that some of the smaller of the particles 64*p*, which are more subject to the forces created by air movement, drift out of the depositing chamber 22, contaminating the atmosphere.

However, in the depositing apparatus 104, the direction of transport of the sheet 18 is reversed so that the sheet enters the depositing chamber 85 at the second end 88 distal from the generator 100. The smaller of the positively-charged particles 64*p* tend to accumulate near the second end 88, and since their deposition is not impeded by any prior deposited charged particles, the smaller particles are generally deposited first. The electrostatic deposition of the larger of the positively-charged particles 64*p* is less significantly impeded by the lower surface charge resulting from the previously deposited smaller particles.

By virtue of their greater surface area, and their greater ability to take an electrostatic charge, the larger of the positively-charged particles 64*p* are attracted to, and deposited on, the sheet 18, even though the sheet 18 has acquired a positive charge from the deposited smaller particles that reduces the attractive force between the particles 64*p* and the sheet 18. The larger particles that are urged through passage 102 to chamber 90 are more easily charged negatively and deposited to neutralize any positive surface charge.

Figure 9:
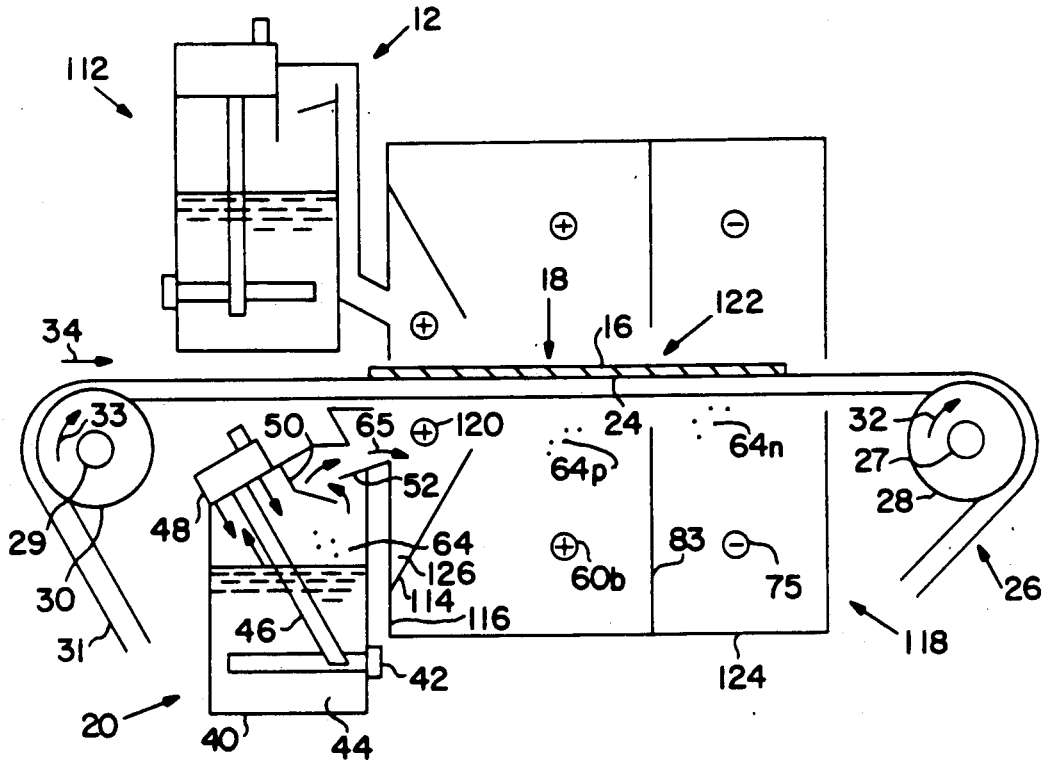
FIG. 9 is a cross-sectional elevation of a sixth embodiment of the present invention, and differs from the embodiment of FIG. 5 in that a deflector is inserted between the depositing electrodes, and one of the electrodes is positioned closer to the work piece, to deflect the particles toward the substrate.

Referring now to FIG. 9, a depositing apparatus 112 illustrates a sixth embodiment of the present invention. In the depositing apparatus 112, a deflector 114 has been inserted intermediate of a first end 116 of a depositing chamber 118 and a depositing electrode 60*b*; and an accelerating electrode 120 has been inserted between the first end 116 and the deflector 114.

The depositing apparatus 112 also includes a baffle 83 and a neutralizing electrode 75 which function as described in conjunction with the embodiment of FIG. 5.

The accelerating electrode 120 is positioned closer to a transporting path 122 than either the depositing electrode 60*b* or the neutralizing electrode 75. In like manner, the accelerating electrode 120 is positioned farther from a bottom cover 124 of the depositing chamber 118 than either the depositing electrode 60*b* or the neutralizing electrode 75.

In operation, the deflector 114 cooperates with the accelerating electrode 120, which is energized to a positive potential as indicated by the "+" sign, and draws uncharged particles 64 of lubricant into an accelerating passage 126 that is formed by the first end 116 and the deflector 114.

In the accelerating passage 126, the accelerating electrode 120 charges the particles 64 to the positively-charged particles 64p. Then, the deflector 114 cooperates with the positive charge on the particles 64p, and with the small volume of air which is used by the aspirator 48, to direct the particles 64p toward, and into depositing contact with, the sheet 18.

In summary, the present invention provides: 1) apparatus and method for electrostatically depositing materials onto substrates and for neutralizing the electrostatic charge on the substrate subsequent to electrostatically depositing; and 2) apparatus and method for more efficiently electrostatically depositing materials, whereby environmental contamination is drastically reduced.

The apparatus and method include a depositing electrode that is energized to one polarity to electrostatically deposit a coating, and a neutralizing electrode that is energized to the other polarity.

The depositing electrodes and the neutralizing electrodes are separated: 1) by an additional space; 2) by a baffle; or 3) by being disposed in separate depositing and neutralizing chambers.

Emissions from the electrostatic depositing apparatus are reduced by: 1) use of a neutralizing electrode whereby some of the particles are recharged to the opposite polarity; 2) furnishing particles from a separate particle generator and charging them to the polarity which is opposite to that which was used in the depositing step; and/or 3) directing the substrate into the electrostatic depositing chamber at a place distal from the site of particle introduction whereby more complete deposting is achieved.

For example, in one embodiment, a repositioned electrode 120 and a deflector 114 cooperate to direct particles 64 toward the transporting path 122 of the sheet 18; and in another embodiment, the direction of transport is reversed so that the smaller particles are deposited first.

While specific apparatus and method have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to electrostatic depositing of various materials, particularly materials which may be aspirated. More particularly, the present invention is applicable to electrostatically depositing lubricants, such as petrolatum.

What is claimed is:

1. A method for electrostatically depositing a material onto a substrate and for electrostatically neutralizing the resultant electrostatic charge of the substrate, which method comprises the steps of:

a. furnishing particles of said material;

b. electrostatically charging said particles to one polarity;

c. electrostatically depositing a first portion of said charged particles onto said substrate;

d. electrostatically recharging a second portion of said charged particles to the opposite polarity generally after said depositing of the first charged particles; and e. electrostatically depositing said second portion of oppositely charged-particles onto said substrate generally after said depositing of the first charged particles.

2. A method as claimed in claim 1 in which said furnishing step comprises supplying said particles to a depositing chamber; and said furnishing step further comprises transporting said second portion of particles from said depositing chamber to a separate neutralizing chamber wherein said second portion of particles are electrostatically recharged and deposited onto said substrate.

3. A method as claimed in claim 1 in which said electrostatic charging step comprises energizing first and second electrodes to a first polarity, said first and second electrodes being disposed within a depositing chamber;

said electrostatic recharging step comprises energizing a third electrode to an opposite polarity, said third electrode being disposed within said depositing chamber; and said method further comprises the step of spacing said third electrode at a greater distance from said first and second electrodes than said first electrode is spaced from said second electrode, said greater distance being sufficient to separate the first portion of particles from the oppositely charged second portion of particles to substantially prevent the recombination of the first and second portions of said particles, said first, second and third electrodes being disposed equal distances from the substrate within the depositing chamber.

4. A method as claimed in claim 1 in which said electrostatic charging step comprises energizing a first electrode to a first polarity;

said electrostatic recharging step comprises energizing a second electrode to an opposite polarity; and said method further comprises isolating said second electrode from said first electrode within a depositing chamber by disposing a barrier therebetween.

5. A method as claimed in claim 1 in which said furnishing step comprises aspirating spheres of a lubricant.

6. A method for electrostatically depositing a lubricant in which a first plurality of particles of said lubricant are electrostatically charged to one polarity by a depositing electrode disposed within a depositing chamber to a first polarity and electrostatically deposited onto a piece of a metallic material within the depositing chamber, including the improvement which comprises:

a. providing a second plurality of particles of a lubricant;

b. electrostatically charging said second plurality of lubricant particles to the opposite polarity by a neutralizing electrode disposed within a neutralizing chamber; and c. electrostatically depositing said electrostatically charged second plurality of lubricant particles onto said piece of said metallic material within said neutralizing chamber generally after the first plurality of lubricant particles are deposited.

7. A method for electrostatically neutralizing the electrostatic charge on a substrate that results from electrostatic deposition of particulate matter, which method comprises:

a. furnishing said matter in electrostatically depositable particles;

b. electrostatically charging a plurality of said depositable particles to one polarity;

c. electrostatically depositing a first portion of said charged particles onto said substrate;

d. electrostatically charging a second portion of said plurality of said depositable particles to the opposite polarity generally after said second portion was charged to said one polarity; and e. electrostatically depositing said second portion of oppositely charged particles onto said substrate generally after the first said depositing step.

8. A method for electrostatically depositing a material onto a substrate and for electrostatically neutralizing the resultant electrostatic charge of the substrate, which method comprises the steps of:

a. furnishing a first plurality of particles of said material to a depositing chamber and a second plurality of particles of said material to a neutralizing chamber;

b. electrostatically charging said first plurality of said particles to a first polarity;

c. electrostatically depositing a first portion of said first plurality of said particles onto said substrate within said depositing chamber;

d. electrostatically charging said second plurality of said particles to the opposite polarity;

e. electrostatically re-charging a second portion of the first plurality of said particles to said opposite polarity; and f. electrostatically depositing said second plurality of oppositely charged-particles and said second recharged portion of said first plurality of particles onto said substrate generally after the depositing of said first charged particles.

9. A method as claimed in claim 8 in which said furnishing step comprises separately generating said first and second pluralities of said particles.

10. A method as claimed in claim 8 in which said furnishing step comprises separately aspirating said first and second pluralities of particles.

11. A method as claimed in claim 8 further comprising the step of transporting the second portion of the first plurality of particles from the depositing chamber to the neutralizing chamber.

12. A method as claimed in claim 8 in which the first said electrostatic charging step comprises energizing a first electrode to the first polarity;

the second said electrostatic charging step comprises energizing a second electrode to said opposite polarity; and said method further comprises the step of isolating said second electrode from said first electrode by disposing the first electrode in said depositing chamber and disposing the second electrode in said neutralizing chamber.

13. Apparatus having means for electrostatically charging a first plurality of particles of a material to a first polarity, and for electrostatically depositing said first-polarity particles onto a substrate, including the improvement which comprises:

means for electrostatically charging a second plurality of particles to the opposite polarity;

generator means for supplying a mixture of said first and second pluralities of particles;

means for separating said second plurality of particles from said first plurality of particles; and means for electrostatically depositing said oppositely-charged second plurality of particles onto said substrate; whereby said oppositely-charged second plurality of particles generally neutralize the electrostatic charge on said substrate caused by said first-polarity particles.

14. Apparatus as claimed in claim 13 in which said generator means includes a first generator for supplying said first plurality of particles and a second generator for supplying said second plurality of particles.

15. Apparatus as claimed in claim 13 in which said apparatus includes means for charging said second plurality of particles to said first polarity prior to said charging of said second plurality of particles to said opposite polarity.

16. Apparatus as claimed in claim 13 in which said means for electrostatically charging said first plurality of particles to said first polarity includes a first electrode; and said means for electrostatically charging said second plurality of particles to said opposite polarity includes a second electrode.

17. Apparatus as claimed in claim 16 in which said apparatus includes means for spacing said second electrode from said first electrode a distance sufficient for effectively isolating said second electrode from said first electrode.

18. Apparatus as claimed in claim 16 in which said apparatus further includes means for isolating said second electrode from said first electrode by spacing said second electrode from said first electrode; and in which said means for electrostatically charging said first plurality of particles includes a third electrode that is disposed proximal to said first electrode at a first distance and distal from said second electrode;

said means for isolating said second electrode from said first electrode comprising spacing said second electrode from said first electrode at a greater second distance than said first distance, said second distance being sufficient to separate the first polarity charged particles from the opposite polarity charged particles to substantially prevent a recombination of the first and second pluralities of said particles.

19. Apparatus as claimed in claim 16 in which said apparatus further includes means for isolating said second electrode from said first electrode comprising a mechanical barrier disposed between said first and second electrodes.

20. Apparatus as claimed in claim 16 in which said apparatus further includes a depositing chamber, and a neutralizing chamber;

said first electrode is disposed in said depositing chamber; and said second electrode is disposed in said neutralizing chamber wherein said oppositely charged particles generally neutralize the electrostatic charge on said substrate caused by said first-polarity particles.

21. Apparatus as claimed in claim 13 in which one of said pluralities of particles includes a mixture of smaller and larger particles; and said apparatus includes means for generally depositing said smaller particles before said larger particles.

22. Apparatus as claimed in claim 21 in which said apparatus includes means for transporting said smaller particles away from said larger particles.

* * * * *